United States Patent [19]

Barosi et al.

[11] 4,146,497

[45] Mar. 27, 1979

[54] SUPPORTED GETTER

[75] Inventors: Aldo Barosi; Brian Storey; Tiziano A. Giorgi; Paolo della Porta, all of Milan, Italy

[73] Assignee: S.A.E.S. Getters S.p.A., Milan, Italy

[21] Appl. No.: 424,710

[22] Filed: Dec. 14, 1973

[51] Int. Cl.[2] ..... H01I 7/18; F04B 37/02

[52] U.S. Cl. ..... 252/181.6; 75/20 F; 106/40 R; 106/65; 252/181.2; 252/181.4; 252/181.7; 417/48; 417/51; 428/637; 428/638; 428/660; 428/680

[58] Field of Search ..... 29/180 R, 191.2; 252/181.6, 181.2, 181.4, 181.5, 181.7, 477 R; 427/247; 417/48, 49, 51; 75/20 F; 204/37 R; 106/65, 40 R; 148/16; 428/638, 660, 680

[56] References Cited

U.S. PATENT DOCUMENTS

| | | | |
|---|---|---|---|
| 3,229,967 | 1/1966 | Engelhard | 148/16 |
| 3,255,027 | 6/1966 | Talsma | 106/65 |
| 3,502,596 | 3/1970 | Sowards | 252/477 R |
| 3,584,253 | 6/1971 | Wintzer | 252/181.6 |
| 3,620,645 | 11/1971 | della Porta et al. | 417/48 |
| 3,627,521 | 12/1971 | Vordahl | 252/181.6 |
| 3,652,317 | 3/1972 | della Porta et al. | 252/477 R |
| 3,679,552 | 7/1972 | Jervis | 204/37 R |
| 3,780,501 | 12/1973 | della Porta et al. | 417/51 |
| 3,926,832 | 12/1975 | Barosi | 252/181.6 |

OTHER PUBLICATIONS

Barosi, R. et al., *Non-Evaporable Getter for Low Temps.,* in *Vacuum,* 23 (1), Jan. 1973, pp. 15–19.

*Primary Examiner*—Arthur J. Steiner
*Attorney, Agent, or Firm*—Littlepage, Quaintance, Murphy, Richardson and Webner

[57] ABSTRACT

This invention relates to a supported getter device comprising a metallic support structure consisting of a three-dimensional network defining a multiplicity of inter-connecting free cells and a particulate getter material substantially filling at least some of said free cells. This invention also relates to a getter device comprising at least one attachment zone of a compressed three-dimensional metal network attached to at least one supported getter material zone comprising a three-dimensional metal network. Methods of making the getter devices are described.

7 Claims, 29 Drawing Figures

SUPPORTED GETTER

BACKGROUND OF THE INVENTION

Getter devices are well known in the art and are used for a variety of reasons. One use is to produce and maintain the vaccum in electrical discharge vessels thus reducing the manufacturing time required to produce said vessels and also increasing their effective working life. Getter devices can also be used within gas or vapor filled electrical discharge vessels such as numerical indicator tubes or fluorescent lamps where their main function is to reduce the presence of reactive gases. Getter devices are also used in a wide variety of other devices such as devices using particle beams (e.g. cathode ray tubes), gas purifiers and nuclear fuel elements.

Getter materials are usually divided into two main groups. Getter materials of the first group are called "flash" or "evaporating" getter materials. These getter materials derive their name from the fact that the getter material is evaporated from its container by quick heating, or flashing. The getter material is then dispersed onto a suitable surface.

In order to place the getter device within the vessel, in the case of non-evaporating getter materials, it is known to paint the getter material in the form of a fine powder held in a binder directly onto one of the components within the vessel such as the anode or the electrode supports. The component is then heated under vacuum whereupon the powdered getter material sinters to the component and the binder evaporates away. However the presence of such a getter material on the functioning parts of the electrical discharge device or other vessels may have a deleterious effect on the efficient operation of such devices. Also their functioning parts may be so delicate that it is not possible to support the getter material on said parts. Frequently it is more economical for the manufacturer of the electrical discharge or other vessel to insert an already fabricated getter device into said vessels rather than make his own getter device within or on the surfaces of said vessels. For these and other reasons it is desirable to produce separate getter devices of both groups which can be used later within a whole variety of electrical discharge or other vessels.

Many attempts have been made to produce suitable getter devices having desired characteristics. In U.S. Pat. No. 2,082,268 active getter material is deposited upon a loosely packed porous structure for example of glass wool, however, the getter device is complex and difficult to manufacture. Moreover, it is very heavy in relation to the amount of getter material contained. U.S. Pat. No. 3,102,633 uses a particulate support of graphite in chemical combination with an alkali metal. Della Porta in U.S. Pat. No. 2,824,640 proposed the use of a ring shaped channel support of "U" section containing an evaporating getter material. However several disadvantages were found, such as low percentage getter metal yields and the production of loose particles or even disintegration of the getter mass when large barium quantities are required to be evaporated. In an attempt to overcome these difficulties, Reash in U.S. Pat. No. 3,428,168 proposes the use of a wire or "L" shaped anchoring element within the support whereas della Porta in U.S. Pat. No. 3,385,420 proposes an increase in the free surface area of the evaporating getter material by removing as much of the support as possible, but increasing the risk of producing loose particles from unsupported edges.

Non-evaporating getter devices have also been used by containing the active getter material in a "U" section ring container and as tablet shaped forms supported upon a wire gauze, see della Porta U.S. Pat. No. 3,225,910. Unfortunately their manufacture involves the use of high compression forces which reduces the porosity of the getter mass and hence reduces its gettering properties. Wire heating coils have also been used to support non-evaporating getter devices (see U.S. Pat. No. 3,584,253), but it is difficult to apply the getter material to the coil in reproducible quantities, and the application process is very lengthy.

Other vapor generating devices contained within a sintered mass of supporting material are described in U.S. Pat. No. 3,579,459. However, the sinterizing material forms at least 30% of the bulk of the vapor generating mixture and still has to be placed in a container. Furthermore, the sintering process is very lengthy, more than 1 hour, and may cause degradation of the other components of the mixture. Such sintered structures are characterized by relatively low porosity. Such sintered structures are also used as dispenser and impregnated cathodes where barium is allowed to diffuse slowly through, or is produced in the porous mass which is usually sintered titanium or molybdenum powder of about 17–27% porosity. Evaporation of barium is very low. Even though the cathode may sorb some gas it is not the required function, which is to produce electrons, and gas sorption is very inefficient. Further the production of these cathodes is very lengthy. Such dispenser and impregnated cathode structures are described in the following references: Revue Technique Philips, Vol. 11, No. 12, pages 349–358 and Revue Technique Philips, Vol. 19, No. 7–8, pages 230–244.

Accordingly it is an object of the present invention to provide an improved getter device which is substantially free from one or more disadvantages of the prior art.

A further object is to provide a getter device having minimum weight in relation to the weights of the getter material so supported.

Another object is to provide a getter device providing minimum obstruction to the desired action of the getter material.

Another object is to provide a getter device adapted to prevent the production of loose particles or disintegration of the getter mass by extending the support throughout the getter mass.

Yet another object is to provide a getter device having a large geometric surface area which defines a volume in which can be placed reproducible quantities of getter material.

A further object is to provide a getter device provided with an integral attachment means.

Another object is to provide a getter device whose attachment means provides minimum obstruction to the getter material.

Another object is to provide a getter device capable of being produced by mass production methods.

Another object is to provide a getter device capable of being attached to its working position as easily as possible and, if required, by automatic means.

Still another object is to provide an improved method for manufacturing a getter device.

Additional objects and advantages of the present invention will be apparent by reference to the following detailed description thereof and drawings wherein.

Figure 1:
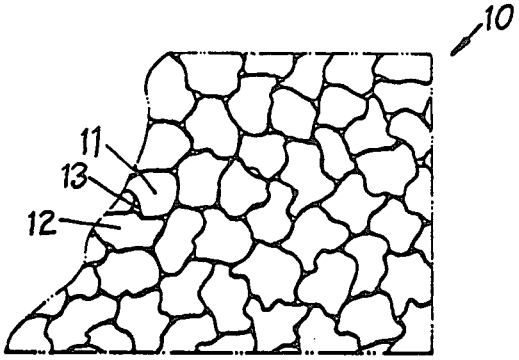
FIG. 1 is a representation of an enlarged view of the surface of a sintered particulate metal body not representative of the present invention.

According to the present invention there is provided a getter device comprising a metallic or ceramic support structure consisting of a three-dimensional network defining a multiplicity of inter-connecting free cells and a particulate getter material substantially filling at least some of said free cells. It has been found that such getter devices have properties at least equal to those of prior art getter devices and yet are supported throughout substantially the whole of the getter mass whilst still allowing the gas to be sorbed to reach the whole of the available getter material without any substantial obstruction. In the broadest sense of the present invention the support structure may be any metal or ceramic capable of being fabricated into a three-dimensional structure defining a multiplicity of inter-connecting free cells.

At higher values of cells per inch (i.e., smaller cells), the particles of getter material will have difficulty in penetrating the structure. At lower values (i.e., larger cells), the supporting action of the structure will be diminished and the gettering material may tend to break away from the support structure.

The gettering material in its broadest aspect may be any gas sorptive composition suitable for use as an evaporating or non-evaporating getter material and is preferably in a particulate form.

The evaporation getter materials useful in the getter devices of the present invention are well known in the art and in general consist of any gas sorptive metal which is vaporizable under the influence of heat at sub-atmospheric pressures. In the broadest aspect any evaporable getter metal which will evaporate at a temperature less than the melting point of the metal or ceramic employed as the cellular support structure can be used in the present invention.

Examples of suitable evaporating getter materials include among others calcium, strontium, magnesium and preferably barium. In general, the getter metal is in the form of an alloy in admixture with a further metal which may react with the alloy upon heating and release the getter metal by means of an exothermic reaction. The preferred evaporating getter powders are granulated alloys of barium and aluminium in admixture with particulate nickel.

The particulate getter material or mixture can be loaded into the multiplicity of inter-connecting free cells of the support structure by any convenient means.

If the support structure cell size is large relative to the getter material or additional component material powder size, then the dry powder can be mechanically poured into the structure whereupon a slight pressure applied to the structure causes a slight reduction in cell size and a partial compacting of individual particles to each other. In this case the support structure would be metallic rather than ceramic.

If the support structure cell size is only slightly larger than the larger of the particles in the getter material of mixture then it may be necessary to give a mechanical or ultrasonic frequency agitation to the support structure during the filling process.

A preferred method of placing the particulate getter alloy or mixture within the inter-connecting free cells of the support structure consists in forming a liquid suspension or paste of the powder and dipping the support structure into the liquid suspension or paste.

By suitable adjustment of the viscosity of the liquid suspension or paste, it will be found that the cellular structure can easily be filled by immersion. At smaller cell sizes and lower viscosities capillary action aids penetration of the liquid suspension or paste into the support structure. For larger cell sizes an ordinary mechanical flow is sufficient to cause penetration of the support structure by the liquid suspension or paste which in this case is of somewhat higher viscosity.

The resultant getter device is then subsequently heat treated in vacuum to remove the liquid and in the case of low temperature non-evaporating getters to cause a partial sintering at 800° C. to 1200° C. of the getter material but without causing any substantial reduction of the real surface area of the getter material.

As the volume to be filled with getter material is defined by the physical size of the cellular support the quantity of getter material taken up into the support is closely controlled and reproducible.

In general, the above described getter devices are prepared by machining the desired shape from a sheet or block of support material and then filling the machined shape with a particulate getter material. According to the broadest aspects of the present invention any convenient means can be employed by which the getter devices can be attached to the system in which it is required to locate the getter devices.

One means is to machine the getter device to shape before filling it with the getter material. It is also possible to provide a separate attachment means for attaching the supported getter device to the system in which it was desired to locate the getter device.

Production of such getter devices is possible but is unfortunately lengthy and requires individual construction of each supported getter device, and connection to the location means. It is therefore difficult to produce such getter devices by mass production methods to obtain the subsequent benefits of cheaper unit production costs and increased reproducibility of the finished product.

Although it had previously been known to compress the metal network used for the getter material supporting means of the present invention (see DT No. 2,200,074), it had not been appreciated that a similar technique could be adapted to provide getter devices having reproducible properties and convenient means of location.

According to another aspect of the present invention, there is provided a getter device comprising at least one attachment zone of a compressed three-dimensional metal network and at least one supported getter material zone comprising a three-dimensional meal network defining a multiplicity of inter-connecting free cells and a particulate getter material substantially filling at least some of the uncompressed free cells.

The three-dimensional metal network is usually provided in the form of a strip or sheet of substantially uniform thickness. Selected zones of the strip or sheet are then compressed by any suitable means leaving a series of zones in the uncompressed state. The transition from an uncompressed zone to a compressed zone should preferably not be too abrupt as cracking of the metal network may occur. It is therefore preferable to provide a transistion zone of increasing degree of compression of structure between the compressed zone and the uncompressed zone. However, for the production of larger getter devices, it may not be possible to provide the transition zone, in which case, it may be convenient to provide a partial cutting action, to partly separate the compressed zone from the uncompressed zone. The compression is provided by any suitable compression means but is preferably provided by a pair of suitably shaped rollers or a step and repeat press. The continuously formed strip or sheet is then caused to pass through a fluidized bed or liquid suspension of particulate getter material contained in a bath which may be ultrasonically agitated to aid uniformity of the suspension and to a facilitate filling of the uncompressed metal network zones by the liquid suspension.

If the support structure cell size is large relative to the getter material or additional component material powder sizes then the dry powder can be mechanically loaded, by automatic machinery, into the open structure whereupon a slight pressure applied to the structure causes a slight reduction in cell size and a partial compacting of individual particles to each other. The strip or sheet then passes through a low temperature drying oven. On issuing from the drying oven the getter devices can be separated one from the other, or in groups, or they can be left as a continuous length or wound on a bobbin due to the relative flexibility of the compressed zones.

The getter devices, either singly or in strips of indefinite running lengths wound on bobbins, are then placed in a vacuum furnace to about $10^{-5}$ to $10^{-6}$ torr and the temperature increased to between 800° C. and 1200° C. during a period of about 25 minutes. The temperature is maintained for about 5 minutes and then the getter devices are allowed to cool to room temperature and are removed from the vacuum furnace. If the strips have not been previously wound on bobbins this can be performed after removal from the oven.

In the broadest sense of the present invention, the support structure may be of any metal capable of being fabricated into a three-dimensional structure defining a multiplicity of inter-connecting free cells. However, the metal should be capable of withstanding the temperatures reached during fabrication and treatment or use of the getter device. Furthermore, it should not react chemically with the getter materials. Non-limiting examples of metals suitable for use as the support structure are nickel, chromium, iron, titanium, cobalt, molybdenum and alloys of these metals between themselves and with other metals. Methods of preparation of these support materials are illustrated in United Kingdom Pat. Nos. 1,263,704 and 1,289,690. See also U.S. Pat. Nos. 3,679,552, and 3,744,427.

In general, the cell size of the support structure is any size that may conveniently be produced with the metal to be used for the support structure. The preferred range of cell size is from 125 cells per inch to 10 cells per inch and preferably from 100 cells per inch to 25 cells per inch. At higher values of cells per inch (i.e., smaller cells) the particles of getter material will have difficulty in penetrating the structure. At lower values (i.e., larger cells), the supporting action of the structure will be diminished and the getter material may tend to break away from the support structure.

The getter material in its broadest aspect may be any gas sorptive composition suitable for use as an evaporating or non-evaporating getter material and is preferably in a particulate form.

The evaporating getter materials useful in the getter devices of the present invention are well known in the art and in general consist of any gas sorptive metal which is vaporizable under the infuence of heat at subatomspheric pressures. In the broadest aspect, any evaporable getter metal which will evaporate at a temperature less than the melting point of the metal employed as the cellular support structure can be used in the present invention.

Examples of suitable evaporating getter materials include among others calcium, strontium, magnesium and preferably barium. In general, the getter metal is in the form of an alloy in admixture with a further metal which may react with the alloy upon heating and release the getter metal by means of an exothermic reaction. The preferred evaporating getter powders are granulated alloys of barium and aluminium in admixture with particulate nickel.

The non-evaporating getter metals useful in the getter devices of the present invention include among others, hafnium, uranium, titanium, zirconium, thorium, vanadium, tantalum, niobium and tungsten and alloys of two or more thereof. These getter metals can also be alloyed with other metals such as aluminium, cerium, manganese or "mishmetall" (for example, a mixture of cerium and lanthanum) so as to effect a selective gas sorptive action or a more complete absorption or also a high efficiency within a wide temperature range. These non-evaporable getter materials are characterized by (1) a sorptive capacity for noxious gases such as oxygen, carbon monoxide, water vapor, hydrogen, nitrogen and carbon dioxide, and (2) a vapor pressure at 1000° C. of less than $10^{-5}$ torr. For particular applications where efficient gas sorption properties are required at low temperatures (approximately room temperature to about 400° C.), the particulate getter material may be mixed with an antisintering agent such as graphite as described in U.S. Pat. No. 3,584,253 or mixed with a particulate zirconium-aluminium alloy as described in U.S. patent application Ser. No. 383,677 filed July 30, 1973. Other powdered antisintering materials can be used either alone or in mixture such as refractory oxides, carbides, etc. In the replacement of one antisintering agent by another, volume ratios of getter powder to antisintering agent powder are preserved. The substitution of one gettering material for another is similarly accomplished. One preferred non-evaporable getter material comprises a mixture of (A) particulated zirconium, and (B) a particulate alloy of zirconium and aluminium, wherein the weight ratio A:B is from 10:1 to 1:1. The preferred zirconium aluminium comprises from 5 to 30 and preferably 13 to 18 weight percent aluminium balance zirconium. The most preferred zirconium aluminium alloy is one of 16 weight percent aluminium balance zirconium, available from SAES Getters S.p.A., Milan, Italy, under the trademark St 101. A second preferred non-evaporable getter material comprises a mixture of (A) particulate zirconium and (B) particulate graphite, wherein the weight ratio of A:B is from 20:1 to 2:1.

Referring now to the drawings and in particular to FIG. 1, there is illustrated in enlargement, a typical sintered body 10 not representative of the present invention, consisting of a plurality of individual particles 11, 12 having between them spaces 13. It is seen that spaces 13 form only a small percentage of the volume defined by the other surfaces of the sintered body 10. If particulate getter material were to be contained within the spaces 13 of the sintered body 10, acting as a support, then the resistance to gas offered by the presence of the large number of particles 11, 12 would prevent efficient access of the gases to the getter material.

Figure 2:
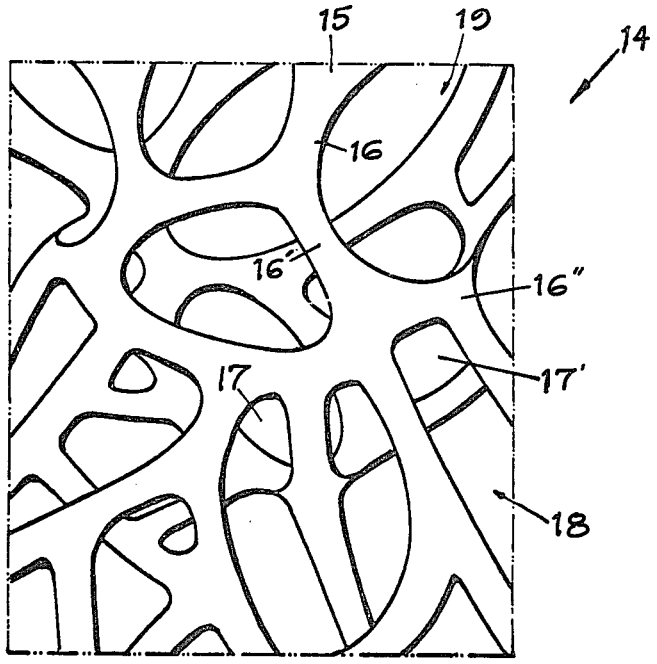
FIG. 2 is a representation of an enlarged view of the getter device of the present invention.

FIG. 2 illustrates, in a very much enlarged form, a support structure 14 useful in the present invention and shows a three-dimensional network 15 of a nickel-chromium alloy. Filamentary branches 16, 16', 16'', etc. of network 15 define open spaces 17, 17', etc. between inter-connecting cells 18, 19, etc. within the three-dimensional network 15. The illustration is of a support structure whose average cell size is 0.5 mm corresponding to approximately 50 cells per inch. A particulate getter material is placed within individual inter-connecting cells 18, 19, etc.

Figure 3:
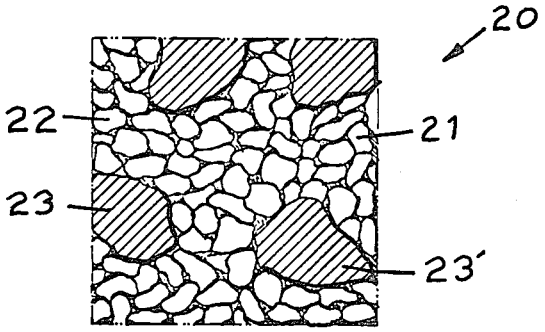
FIG. 3 is a representation of an enlarged view of a non-evaporating getter material useful in the present invention.

FIG. 3 represents in a very much enlarged form a non-evaporating low temperature zirconium getter material 20 comprising getter metal particles 21, 22 in admixture with a particulate Zr-Al alloy antisintering powder 23, 23'.

Figure 4:
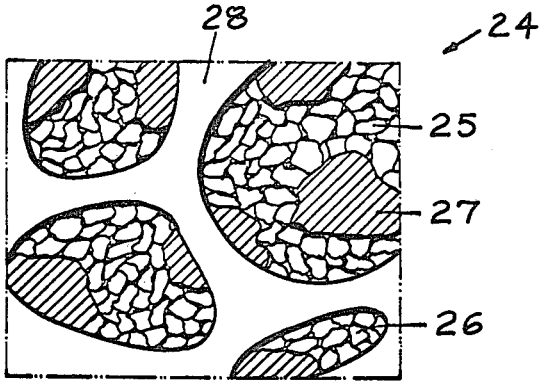
FIG. 4 shows the surface of a non-evaporating supported getter of the present invention.

FIG. 4 shows the surface of a non-evaporating getter device 24 of the present invention wherein particles 25, 26 of zirconium in admixture with particles 27 of a Zr-Al alloy are supported in the three-dimensional network 28.

Figure 5:
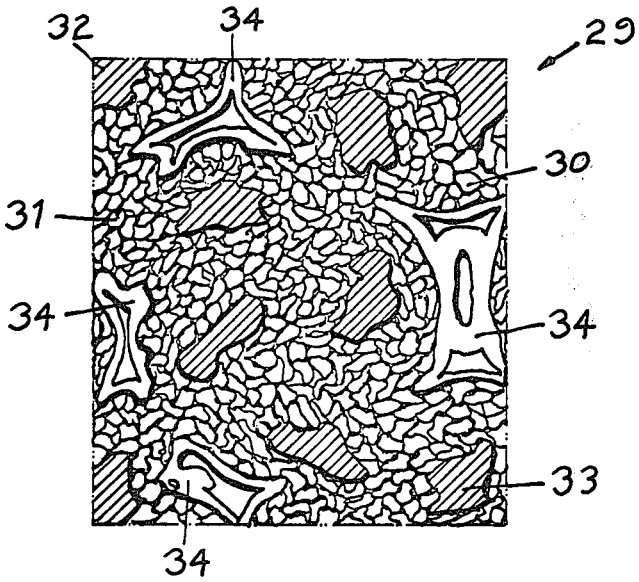
FIG. 5 is an enlarged cross-section of a non-evaporating supported getter of the present invention.

FIG. 5 shows an enlarged cross-section of a non-evaporating supported getter device 29. Particles 30, 31 of zirconium are in mixture with particles 32, 33 of graphite and are supported in the three-dimensional network 34 of nickel-chromium.

Figure 6:
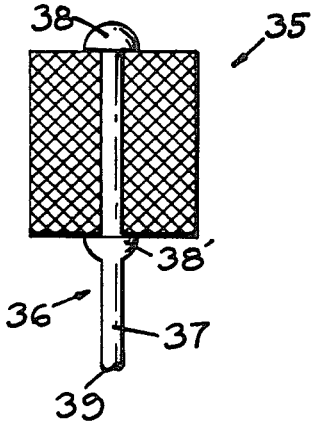
FIG. 6 is a sectional view of a getter device of the present invention.

FIG. 6 is a view of a getter device 35 of the present invention consisting of a multicellular structure of the type described above, of substantially cylindrical shape, containing a getter material as previously defined. Such a getter device can be mounted inside a vacuum tube or other vessel in which the getter is to be used, by means of a mounting element 36 which in this case is a pin (rivet, rod?) 37 passing through the structure and headed at 38 and 38', at the two ends of the structure, so as to hold the getter device with which it becomes integral. End 39 of pin 37 is then fixed to the vacuum tube or other device in which the getter 35 is to be used, by any known means, for example welding.

Pin 37 can be of any suitable material, used in the art, as for example copper or steel. Obviously the same shape and mounting means 36 can be used when device 35 is not a getter, but a cathode as previously mentioned.

Figure 7:
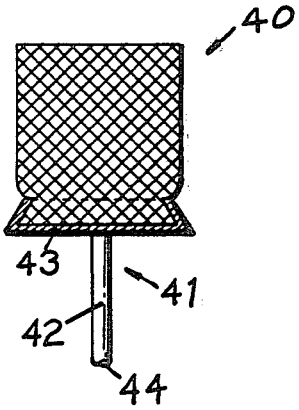
FIG. 7 is a sectional view of a second getter device of the present invention.

FIG. 7 shows a second possible form of a getter device 40 of the present invention which initially has the same cylindrical shape as shown in FIG. 6, but in which the mounting element 41 is a pin 42 integral with an element 43 of a truncated cone shape whose smaller diameter is smaller than the diameter of getter structure 40. Within the truncated cone element 43 there is inserted (forced) by known ways and means one end of the getter, whose multicellular structure of the present invention is thus partly crushed and becomes integral with pin 42 whose end 44 can then be fixed to the vacuum or other device.

The insertion step is preferably performed before filling the structure of getter 40 with the getter material. Also in this case device 40 can be cathode.

Figure 8:
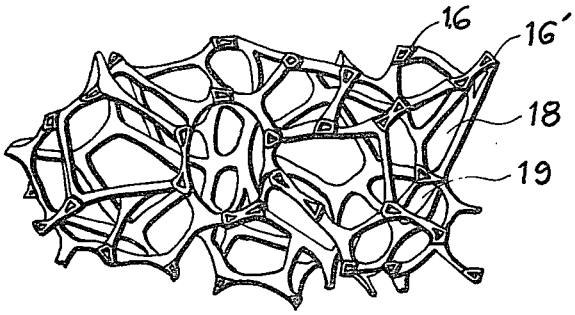
FIG. 8 is a sectional view of a metallic support structure consisting of a three-dimensional network useful in the present invention.
Figure 9:
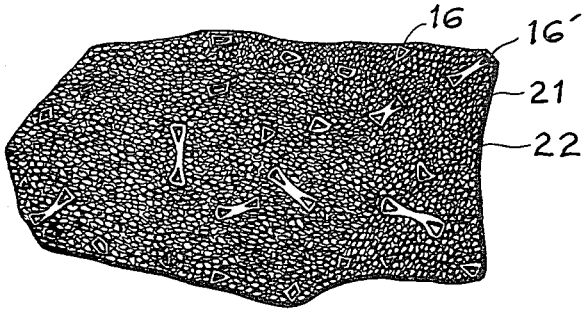
FIG. 9 is a representation of the network of FIG. 8, but is shown filled with a getter material.
Figure 10:
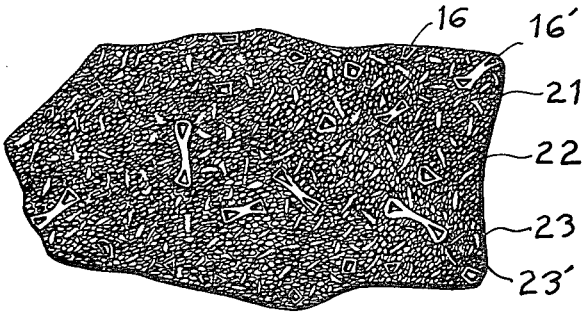
FIG. 10 is a representation of the network of FIG. 8, but is shown filled with an alternate getter material.

FIG. 8 is a sectional view of the network 14 of FIG. 2, showing filamentary branches 16, 16' and cells 18, 19. In FIG. 9, the cells 18, 19 of FIG. 8 are filled with particles 21, 22 of a non-evaporable getter metal. In FIG. 10, the cells 18, 19 of FIG. 8 are filled both with particles 21, 22 of a getter metal and also particles 23, 23' of a anti-sintering agent.

Figure 11:
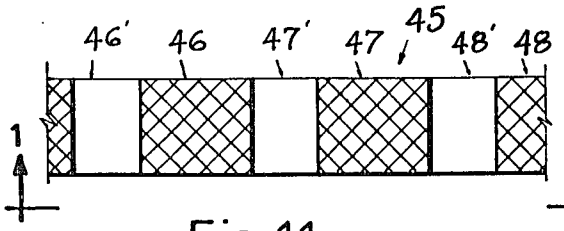
FIG. 11 is a plan view of a strip useful in the present invention.
Figure 12:
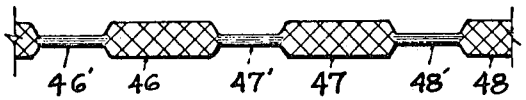
FIG. 12 is an end view along line 1–1' of FIG. 11.

FIG. 11 shows a plan view of a strip 45 of indefinite running length comprising rectangular zones 46, 47, 48 of a three-dimensional metallic support structure defining a multiplicity of inter-connecting free cells interspaced by rectangular zones 46', 47', 48' of compressed metallic support structure. FIG. 12 shows an end view along line 1–1' of FIG. 11 where the rectangular support structures 46, 47, 48 are interspaced by the compressed structures 46', 47', 48'.

Figure 13:
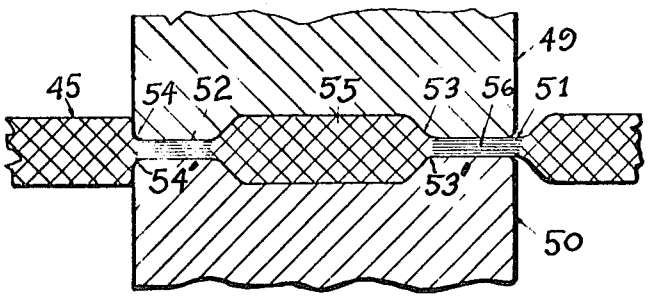
FIG. 13 is a schematic view of a press suitable for the production of a strip useful in the present invention.

FIG. 13 shows an upper die 49 and a lower die 50 of a press used for compressing zones 51 and 52 of a strip 45 of three-dimensional support structure. Shaped surfaces 53, 53', 54, 54', etc. ensure a transition zone of increasing compression on going from the uncompressed zone 55 to the compressed zone 56.

Figure 14:
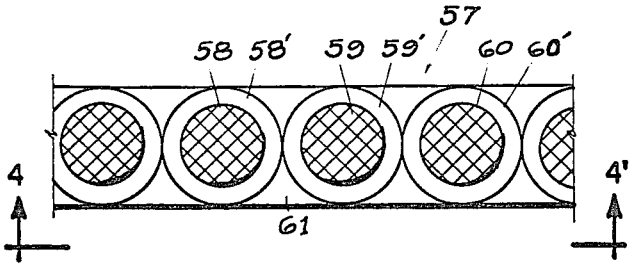
FIG. 14 is a plan view of an alternative strip useful in the present invention.
Figure 15:
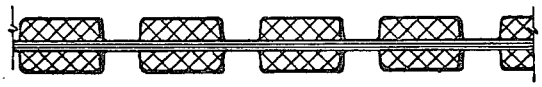
FIG. 15 is an end view along 4–4' of FIG. 14.

FIG. 14 shows a plan view of an alternative strip 57 of indefinite running length comprising circular zones 58, 59, 60 of a three-dimensional metal support structure interspaced by annular zones 58', 59', 60' of compressed metallic support structure. The remaining zones 61 of the strip 57 are at least partially compressed to give a flexibility to the strip which aids further processing. FIG. 15 is an end view along line 4–4 for a strip in which the zones 61 have been compressed to the same degree as zones 58', 59', 60'.

Figure 16:
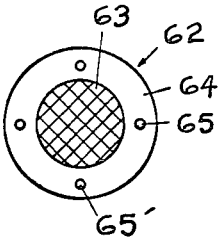
FIG. 16 is a plan view of a getter device produced from the strip of FIG. 15.

FIG. 16 is an alternative ring structure 62 separated from its strip showing a non-compressed zone 63 containing particulate getter material and a compressed zone 64. Furthermore, there are punched holes 65, 65', etc. in the compressed zone 64. These punched holes are produced simultaneously with the compression but could be produced in a subsequent operation.

Figure 17:
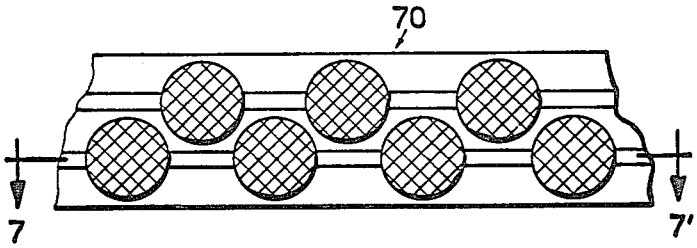
FIG. 17 is a plan view of an alternative strip useful in the present invention.
Figure 18:
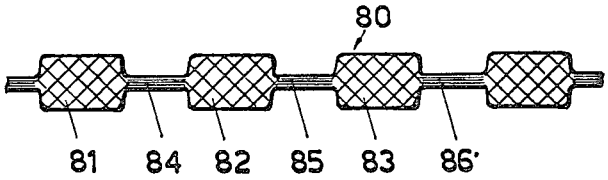
FIG. 18 is a sectional view along line 7–7' of FIG. 17.

FIG. 17 shows an alternative strip 70 of indefinite running length from which are stamped continuous strips 80, shown in FIG. 18, comprising discs 81, 82, 83 etc. of non-compressed metallic support structure joined to neighboring discs by lengths 84, 85, 86, etc. of compressed support structure to form attachment means.

Figure 19:
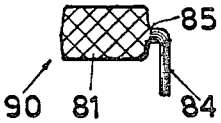
FIG. 19 is a side view of a getter device produced from the strip of FIG. 17.

FIG. 19 shows an individual getter device 90 comprising a getter material support structure 81 containing particulate getter material, and attachment means 84 which has been separated from its neighboring support structure 82 as shown in FIG. 18. Attachment means 84 has been given a bend 85 to provide a more compact form.

Figure 20:
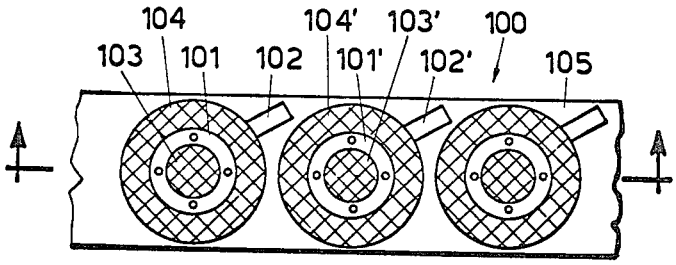
FIG. 20 is a plan view of an alternative strip useful in the present invention.
Figure 21:
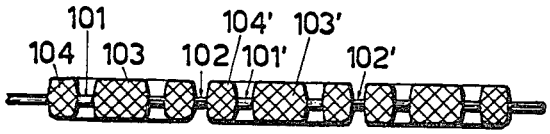
FIGS. 21, 22 and 23 show various stages in the production of the getter devices of FIGS. 22 and 24 from the strip of FIG. 20.
Figure 22:
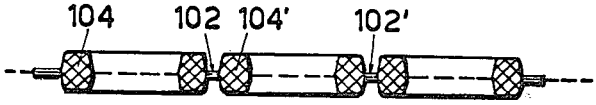
Figure 24:
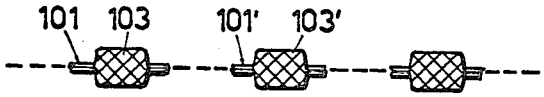
FIG. 24 shows a plan view of an alternative strip useful in the present invention.
Figure 23:
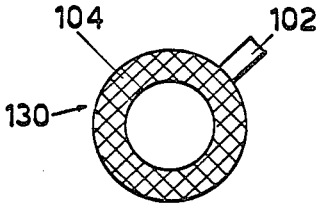
Figure 25:
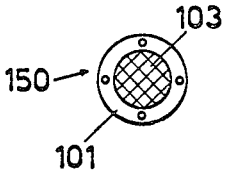
FIG. 25 is a plan view of an alternative getter device of the present invention.

FIGS. 20 to 25 show the simultaneous production of differently shaped getter devices thus providing an economic use of the metal network material. FIG. 20 shows a plan view of a strip 100 of indefinite running length comprising annular compressed attachment zones 101, 101', further compressed attachment zones 102, 102' and uncompressed getter material support zones 103, 103' together with further uncompressed getter support zones 104, 104'.

After the uncompressed zones have been at least partially filled with particulate getter material, and at any convenient subsequent stage, getter devices 130 (FIG. 23) comprising supported getter zones 104 and attachment zones 102 and getter devices 150 (FIG. 25) comprising supported getter zones 103 and attachment zones 101 are separated from each other and from the remaining zones 105 of strip 100, by any suitable means not forming part of the present invention.

Figure 26:
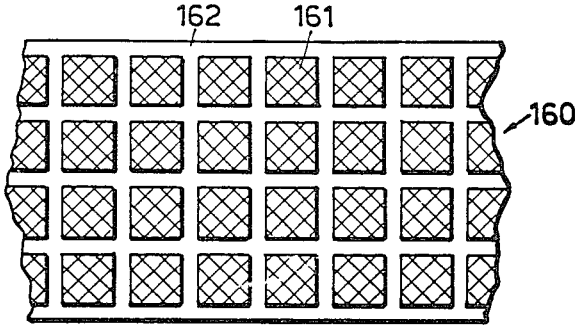
FIG. 26 is a plan view of a plurality of getter material support structures of the present invention.

FIG. 26 shows a strip 160 of indefinite running length comprising a plurality of regularly arranged rectangles 161 of getter material support structure separated by a pattern 162 of compressed support structure. This structure is particularly useful when different quantities of getter material are required in different devices as the correct number of rectangles 161, filled with getter material can be cut from the strip 160 and it is not necessary to maintain stocks of a multitude of different designs of getter devices.

Figure 27:
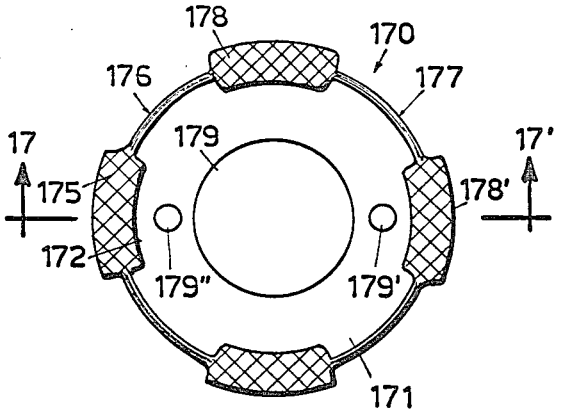
FIG. 27 is a plan view of an alternative getter device of the present invention.
Figure 28:
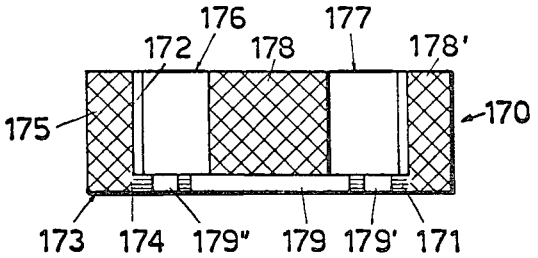
FIG. 28 is a sectional view along line 17–17' of FIG. 27.

FIG. 27 is a top view and FIG. 28 is a view along line 17–17' of FIG. 27, of a getter device 170 where the thickness of the three-dimensional network is relatively large and difficulties are found in the provision of a transition zone between the compressed zone and the uncompressed zone in part of the device. In this case, the attachment means is in the form of a disc 171 formed by compressing the central portion of the network whilst simultaneously cutting along surfaces 172. The cut however finishes before arriving at the lower surface 173 thus leaving a zone 174 whereby the compressed disc 171 remains attached to the uncompressed zone 175. Further portions 179, 179', 179'' of the compressed disc can be completely removed to provide both insertion holes or to remove areas which might cause obstruction to the working of the vessel in which the getter device is placed such as in travelling wave tubes where beams of particles are used or when placed around cathodes or the removal is simply to decrease the weight of the getter device.

The uncompressed zone 175 may have the form of a continuous hollow cylinder or the walls of this cylinder may be further compressed in areas 176, 177 etc. to define a plurality of separate getter material support zones 178, 178', etc.

Figure 29:
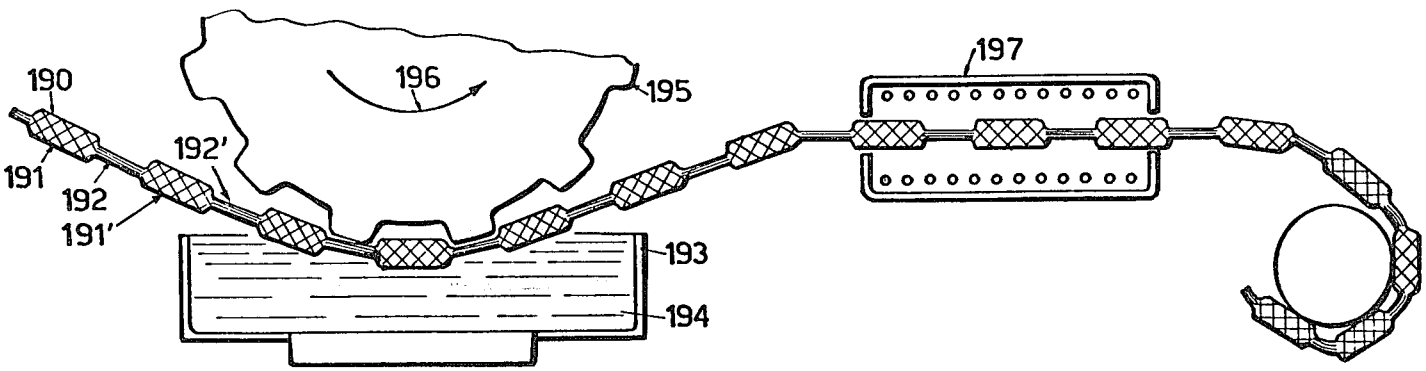
FIG. 29 is a schematic view of a method of producing getter devices of the present invention.

FIG. 29 illustrates a strip 190 of indefinite running length comprising zones 191, 191' of uncompressed metallic support structure and interspacing zones 192, 192' of compressed metallic support structure. The strip 190 is passed through a continuously agitated bath 193 containing a liquid suspension 194 of particulate getter material. Toothed wheel 195 engages the compressed zones 192, 192' of strip 190 and upon rotation in the direction shown by arrow 196 causes the strip 190 to be moved through the liquid suspension 194 whereupon the liquid suspension 194 penetrates the uncompressed zones 191, 191' and is retained therein. The degree of immersion is controlled by the height of the toothed wheel axis of rotation (not shown) above the surface level of the liquid suspension 194. On leaving bath 193 strip 190 moves through a drying oven 197 which is held at a temperature sufficient to evaporate the liquid used for the suspension 194 but not so high a temperature that the getter material becomes active or deteriorates in any way.

Strip 190 then moves out of the oven and is collected by being wound on a bobbin. Alternatively the getter devices can be separated one from another and collected individually. The getter devices are then heat treated in vacuum as previously described.

The invention is further illustrated by the following examples in which all parts and percentages are by weight unless otherwise stated. These non-limiting examples are illustrative of certain embodiments designed to teach those skilled in the art how to practice the invention and to represent the best mode for carrying out the invention.

EXAMPLE 1

This example illustrates the preparation of a getter device of the present invention. Particulate zirconium (10g) was mixed with particulate graphite (1g) as taught by Wintzer in U.S. Pat. No. 3,584,253 and then mixed with ethanol (20g) to form a fairly fluid paste in the form of an alcoholic suspension. A disc of nickel-chromium alloy, consisting of a three-dimensional network defining a multiplicity of interconnecting cells and having a cell size of about 0.5 mm diameter (50 cells per inch) produced in accordance with Example 1 of U.S. Pat. No. 3,679,552 was machined to size of 11 mm diameter, 2 mm thickness from a 2 mm thick sheet of said alloy network.

The disc was slowly immersed in the alcoholic suspension gently agitated and then removed. The heated disc was then placed in a vacuum of about $10^{-5}$ to $10^{-6}$ torr. The temperature was increased from room temperature to between 800° and 1100° C. during a period of about 25 minutes. The temperature between 800° and 1100° C. was maintained for a further 5 minutes. The treated disc which now constitutes a getter device was allowed to cool to room temperature and was then removed from the vacuum furnace.

The getter device can now be placed in an at least partially evacuated enclosure and, after activation by heating the device again to 950° C. for 5 minutes the getter device sorbs active gases.

EXAMPLE 2

A getter device as prepared and described in Example 1 was taken and placed in a standard vacuum vessel suitable for the measurement of gettering properties. The vessel was evacuated and the getter device was heated to between 900°-1000° C. to activate it and allowed to cool to room temperature. The getter device was allowed to sorb gaseous carbon monoxide and the rate of gas sorption and the quantities sorbed were measured at various intervals of time.

It was found that the supported getter possessed at least equal gas sorption rates and sorbed at least equal quantities of gas as a prior art getter prepared with the same gettering materials and having the same gettering mass as in Example 1 but applied to a heating spiral as in U.S. Pat. No. 3,584,253.

EXAMPLE 3

This example illustrates the use of the getter device as a rare gas purifier.

A cylinder of diameter 11.5 mm and thickness 11 mm is machined from a sheet of titanium comprising a three-dimensional network of interconnecting cells having 20 cells per inch. The cells are then filled with a particulate getter material and heat treated as in Example 1. The cylinder is then placed in the center of a tube having an internal diameter of 11.5 mm so that on causing a gas to flow through the tube the gas must pass through the supported getter structure.

A source of argon containing small amounts of oxygen and nitrogen as impurities and containing a pressure measuring instrument are placed at one end of the tube and at the other end are placed instruments to measure the flow rate and pressure and purity of the exit gas. The getter device is heated to between 800° and 1000° C. for 5 minutes to activate the getter material. After cooling to a previously selected temperature depending on the impurities present the argon is allowed to flow through the tube. At a pressure difference across the supported getter of 0.5 atmospheres a gas flow rate of at least 150cc atmospheres per minute is observed. The impurity content of the argon is reduced.

EXAMPLE 4

The argon to be purified in Example 3 is replaced by hydrogen with similar results.

EXAMPLE 5

This example illustrates the preparation of a getter device of the present invention. A strip of nickel-chromium alloy, of length 60cm, width 1cm and thickness 0.2cm, consisting of a three-dimensional network defining a multiplicity of interconnecting cells and having a cell size of about 0.5 mm diameter (50 cells per inch) is passed through a press so that at equally spaced distances of 2cm there is compressed a 1cm length of the network. The strip is then passed through a bath, which is ultrasonically agitated, comprising particulate zirconium, graphite and ethyl alcohol in the ratio 10:1:5 respectively. As the strip comes out of the bath it is passed through an oven where it is heated to a temperature of 60° C. for 20 min. The treated strip is then placed in a vacuum furnace about $10^{-5}$ to $10^{-6}$ torr. The temperature is then increased from room temperature to between 800° and 1000° C. during a period of about 25 minutes. This temperature is maintained for a further 5 minutes. The treated strip is then allowed to cool to room temperature and is then removed from the vacuum furnace. The strip of getter devices with attachment zones is then wound onto a bobbin. A getter device together with its attachment zone is cut from a strip which has previously been wound on a bobbin. By means of the attachment zone the getter device is held in an at least partially evacuated enclosure. After activation by heating the getter device to 900° C. for 10 minutes, the getter device sorbs active gases.

EXAMPLE 6

A getter device is prepared as in Example 5 except that the graphite is replaced by an equal volume of an 84 percent zirconium balance aluminium alloy of the same particle size.

EXAMPLE 7

A getter device is prepared as described in Example 1 and is placed in a standard vacuum vessel suitable for the measurement of gettering properties. The vessel is evacuated and the getter device is heated to 900° C. for 10 minutes, to activate it. The getter device is then allowed to cool to room temperature. The getter device is then allowed to sorb gaseous carbon monoxide and the rate of gas sorption and the gas quantities sorbed is measured at various intervals of time.

It is found that the getter device possesses at least equal gas sorption rates and sorbs at least equal quantities of gas as a prior art getter device prepared with the same getter materials and having the same mass as the getter device in Example 5 but applied to a support structure without an integral attachment means.

EXAMPLE 8

This Example illustrates the preparation of an evaporating getter device of the present invention. A strip of nickel-chromium alloy of length 60cm, width 1cm and thickness 0.2cm consisting of three dimensional network defining a multiplicity of interconnecting cells and having a cell size of about 0.5mm diameter (50 cells per inch) is passed through a press so that at equally spaced distances of 2cm there is compressed a 1cm length of the network. The strip is then passed through a powder dispensing machine so that the uncompressed portions of the strip are caused to be filled with a powder comprising a mixture of nickel and an alloy of 50 percent barium balance aluminium. The strip then passes to a further press which causes a slight compacting of the individual getter material particles in the previously uncompressed portion of the strip. The strip of getter devices with attachment zones is then wound onto a bobbin. When placed in an evacuated vessel and heated barium vapor is released.

Although the invention has been described in considerable detail with reference to certain preferred embodiments thereof, it will be understood that variations and modifications can be effected within the spirit and scope of the invention as described above and as defined in the appended claims.

What is claimed is:

1. A getter device comprising:

(a) a titanium or nickel support structure consisting of a three-dimensional network defining a multiplicity of inter-connecting free cells having between 25 and 100 cells per inch and (b) a getter material comprising:

(i) particulate zirconium (ii) particulate graphite wherein the weight ratio of (i) : (ii) is from 20:1 to 2:1, said getter material substantially filling a plurality of said free cells and affixed therein.

2. A getter device comprising:

(a) a titanium or nickel support structure consisting of a three-dimensional network defining a multiplicity of inter-connecting free cells having between 25 and 100 cells per inch and (b) a getter material comprising:

(i) a particulate zirconium (ii) a particulate alloy of 13 to 18 weight percent aluminum balance zirconium wherein the weight ratio of (i) to (ii) is from 10:1 to 1:1, said getter material substantially filling a plurality of said free cells and affixed therein.

3. A getter device of claim 2 in which the zirconium-aluminium alloy has a composition zirconium 84%-aluminium 16%.

4. A getter device comprising at least one attachment zone and at least one supported getter material zone wherein (a) the attachment zone comprises a compressed metallic structure consisting of a three-dimensional network defining a multiplicity of inter-connecting free cells and (b) the supported getter material zone comprises (i) a metallic support structure constructed of metal selected from the group consisting of nickel, chromium, iron, titanium, cobalt, molybdenum and alloys containing at least one of these metals, consisting of a three-dimensional network defining a multiplicity of inter-connecting free cells having between 10 and 125 cells per inch and (ii) a particulate non-evaporating getter material comprising at least one metal selected from the group consisting of Zr, Ta, Hf, Nb, Ti, Th, and U, substantially filling a plurality of said free cells and affixed therein.

5. A getter device of claim 4 in which the compressed areas define a plurality of spaced non-compressed areas.

6. A getter device comprising at least one attachment zone and at least one supported getter material zone wherein (a) the attachment zone comprises a compressed metallic structure consisting of a three-dimensional network defining a multiplicity of inter-connecting free cells and (b) the supported getter material zone comprises (i) a metallic support structure consisting of a three-dimensional network defining a multiplicity of inter-connecting free cells having between 10 and 125 cells per inch and (ii) a getter material comprising (A) particulate zirconium (B) particulate graphite wherein the weight ratio of (A) to (B) is from 20:1 to 2:1, said getter material substantially filling a plurality of said free cells and affixed therein.

7. A getter device comprising at least one attachment zone and at least one supported getter material zone wherein (a) the attachment zone comprises a compressed metallic structure consisting of a three-dimensional network defining a multiplicity of inter-connecting free cells and (b) the supported getter material zone comprises (i) a metallic support structure consisting of a three-dimensional network defining a multiplicity of inter-connecting free cells having between 10 and 125 cells per inch and (ii) a getter material comprising (A) particulate zirconium (B) a particulate alloy of 13 to 18 weight percent aluminum balance zirconium wherein the weight of (A) to (B) is from 10:1 to 1:1, said getter material substantially filling a plurality of free cells and affixed therein.

* * * * *

UNITED STATES PATENT AND TRADEMARK OFFICE

CERTIFICATE OF CORRECTION

PATENT NO. : 4,146,497

DATED : March 27, 1979

INVENTOR(S) : Barosi, Storey, Giorgi and della Porta

It is certified that error appears in the above-identified patent and that said Letters Patent are hereby corrected as shown below:

[30] FOREIGN APPLICATION PRIORITY DATA

| | | |
|---|---|---|
| December 14, 1972 | Italy | 32882 A/72 |
| January 18, 1973 | Italy | 19336 A/73 |

Page 1, Column 2 under "Other Publications" the author is Barosi, A. et al.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*